US008171693B2

(12) United States Patent
Banova

(10) Patent No.: US 8,171,693 B2
(45) Date of Patent: May 8, 2012

(54) INTERLOCKING MASONRY BLOCKS

(76) Inventor: Aldo Banova, Las Vegas, NV (US)

( * ) Notice: Subject to any disclaimer, the term of this patent is extended or adjusted under 35 U.S.C. 154(b) by 36 days.

(21) Appl. No.: 11/933,423

(22) Filed: Nov. 1, 2007

(65) Prior Publication Data

US 2009/0113835 A1 May 7, 2009

(51) Int. Cl.
*E04B 2/46* (2006.01)

(52) U.S. Cl. ..... 52/592.5; 52/605; 52/606; 52/379

(58) Field of Classification Search ..... 52/569, 52/571, 379, 561, 572, 592.1–592.5, 596, 52/605, 606, 612; D25/113–114, 118, 121
See application file for complete search history.

(56) References Cited

U.S. PATENT DOCUMENTS

| | | | | |
|---|---|---|---|---|
| 4,577,447 | A * | 3/1986 | Doran | 52/571 |
| 4,614,071 | A * | 9/1986 | Sams et al. | 52/309.12 |
| 5,802,797 | A * | 9/1998 | Storer-Folt | 52/604 |
| 6,253,519 | B1 * | 7/2001 | Daniel | 52/591.1 |
| 6,397,549 | B1 * | 6/2002 | Baldwin | 52/596 |
| 6,962,028 | B2 * | 11/2005 | Banova | 52/592.5 |
| 7,546,716 | B1 * | 6/2009 | Asadurian | 52/570 |
| 7,584,584 | B2 * | 9/2009 | Fennell, Jr. | 52/607 |
| 7,665,269 | B2 * | 2/2010 | Azar | 52/592.1 |
| 2002/0056237 | A1 * | 5/2002 | Price | 52/169.12 |
| 2002/0148187 | A1 * | 10/2002 | Walters | 52/604 |
| 2004/0028484 | A1 * | 2/2004 | Woolford | 405/286 |
| 2004/0179903 | A1 * | 9/2004 | Rainey et al. | 405/284 |
| 2005/0252147 | A1 * | 11/2005 | MacDonald et al. | 52/606 |
| 2006/0059839 | A1 * | 3/2006 | Azar | 52/606 |
| 2007/0107364 | A1 * | 5/2007 | Estes et al. | 52/606 |
| 2007/0175150 | A1 * | 8/2007 | Price | 52/483.1 |
| 2008/0236081 | A1 * | 10/2008 | Kennedy | 52/405.1 |

* cited by examiner

*Primary Examiner* — William Gilbert
*Assistant Examiner* — Alp Akbasli
(74) *Attorney, Agent, or Firm* — Jeffrey D. Moy; Weiss & Moy, P.C.

(57) ABSTRACT

The present invention provides a block useful in the construction of walls and structures that is shaped in the general form of a rectangular solid. A horizontal channel extends along the entire length dimension of the block, open coincident with the top of the block. An open vertical channel associated with each end faces outwards toward an adjacent masonry block end. A protruding portion extends from the flat bottom with the same width of the open channel on the top, so that an interlocking connection is formed. A protruding rectangular portion is optionally incorporated into the front face portion, and also optionally into the rear face portion, leaving a recess along one end, and along the top, so that when assembled into a wall, the recessed parts of the face portion give the appearance of mortar joints. Vertical and horizontal rebar may be set within the aligned channels of the blocks when assembled into a wall. The blocks do not require excessive lifting when assembled to a wall or structure to clear vertically aligned set rebar.

3 Claims, 14 Drawing Sheets

INTERLOCKING MASONRY BLOCKS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention relates generally to masonry blocks. More specifically, the invention relates to novel interlocking masonry blocks that readily form continuous wall sections with mortar-less joints that present the appearance of mortared joints.

BACKGROUND OF THE INVENTION

Concrete block constructions of the prior art are made of individual blocks which are conventionally rectangular, and which generally have one or more cavities or channels through the blocks from their top to bottom. During their use in fabricating structures, a layer of mortar is applied onto a foundation, and a course of closely spaced blocks are laid onto the mortar layer, with additional mortar applied between the contiguous block ends. Another layer of mortar is applied to the top of the first course and additional courses are similarly laid, generally staggering the block ends from course to course.

Preparation of multiple batches of the mortar must be done continuously as the wall is built before the mortar sets, and a degree of skill is required to achieve level courses and a vertical wall. Because of the skill required, and additional time in preparing mortar and applying it to each block, construction costs due to labor can be substantial.

The prior art discloses several specialized blocks that have been developed over the years. A general feature has been provisions formed into the blocks to enable them to be dry-stacked, where the inclusion of a layer of mortar between layers and adjacent blocks is eliminated. However, the appearance of such mortar joints is a desirable feature for aesthetic reasons, and some art incorporates designs into the block to simulate such mortar joints.

All of the blocks described in the prior art incorporate channels, cavities, or holes from the upper to lower surface of each block to allow steel reinforcing bars (rebar) to be placed vertically inside the holes, extending through several layers so that when combined with cement, concrete, or grout, superior strength properties for the assembled wall of structure result.

However, in the practice of the art, vertically oriented rebar that has been previously set in a concrete footer or foundation, or has been set in the grout previously poured into a lower layer of blocks requires the lifting of each masonry block to a significant height, above the top of the rebar, to set each in place. In the extreme, each layer of masonry block is lifted to the height of the highest, final layer of blocks, before it is positioned at its own final height, which except for the final layer will be at a lower elevation. The repetitive motions of lifting of the many blocks that comprise a completed wall requires exertion and consumes time from the worker, and introduces fatigue, physical strain, and a risk of injury. None of the prior art adequately addresses this problem.

Thus for example, in U.S. Pat. No. 4,031,678 Schuring discloses an interlocking building block construction comprising an overlapping masonry block having opposite sides, stepped opposite upper and lower longitudinal faces, and stepped opposite vertical end faces. There are spaced tapered recesses with flat bottom surfaces that are located on the upper longitudinal face, and correspondingly shaped lugs that are formed in the lower longitudinal face. There are two enlarged rectangular openings extending entirely through the block located in the central area of the upper and lower faces between the vertical end faces. Small apertures are formed in and adjacent to the lugs for receiving pins for interlocking adjacent blocks. Header blocks, pilaster blocks, partition blocks and filler blocks are provided for interlocking assembly with the interlocking building blocks to build walls of a building without the use of grout or cement.

In U.S. Pat. No. 4,075,808 Pearlman discloses a masonry block having vertically and horizontally offset front and rear faces which form a tongue and groove interlocking feature. The masonry blocks also have bed-to-bed face passages and header-to-header channels to allow mortar to be poured into the masonry element to rigidly hold the masonry block in place. No special importance is placed on the outward appearance of the front face of a structure made with these masonry blocks.

In U.S. Pat. No. 4,514,949 Crespo discloses a wall comprising layers of longitudinally aligned blocks, the blocks having approximately parallel front and back faces connected by transverse webs defining chambers between the webs that are open at the top and bottom. The webs and end faces of each block include depressions in the tops, machined to a specific depth in relation to the height of the block. The upper face of the webs are formed with longitudinally aligned V-shaped grooves which are accurately positioned at a uniform distance from the front faces of the blocks, and steel rebar is fitted in the grooves and extending longitudinally and horizontally from one block to the next to provide longitudinal alignment of the blocks in each row.

In U.S. Pat. No. 5,003,746 Wilston discloses a wall assembly comprising repeating building blocks with vertical channels or holes. Each block is generally rectilinear with the exception of two end walls having round circumferential male and female mating surfaces, respectively. Each circumferential male and female mating surface has a radial dimension almost equal to the width of the block, where each end wall being rotatively engageable with an arcuate mating end wall of an adjacent block of the assembly at any desired angle of rotation within a limited range of arc. The vertical channels or holes comprise means for receiving vertical aligned steel rebar, each hole being aligned with a hole of a block of an adjacent row stacked above and below it.

In U.S. Pat. No. 5,024,035 Hanson discloses a mortarless, lightweight block and walls formed therefrom. The block is generally rectangular and comprises side walls, end walls, and an interior wall which divides the interior of the block into two vertical channels or passages through the block. In certain blocks, parts of the end and interior walls are removed to form horizontal channels through the blocks. The blocks are provided with projections and recesses having rectangular cross sections by which means they may be interlocked together to form walls. In such a wall, the vertical passages and horizontal channels may receive reinforcing steel bars to impart added strength and load bearing properties to the wall.

In U.S. Pat. No. 5,685,119 Zschoppe sets forth shaped bricks joined in a dry construction system. Each brick has a first bearing surface which is provided with a groove formed laterally with a lateral recess, and a second bearing surface which is provided with a key formed laterally with a lateral projection. The projection and the recess are complementary and positioned such that the projection on a first brick is engaged with the recess of a second brick. When stacked, the bricks form chases extending perpendicular to the bearing surfaces and include a central channel and semi tubular channels at opposing end faces. The channels so formed may be used for insertion of steel rebar.

In U.S. Pat. No. 5,715,635 Sherwood discloses a masonry block that includes a pair of mounting strips projecting outwardly from the block supporting faces, each of the strips having an outer planar surface recessed inwardly from the adjacent parallel supporting faces of the block a predetermined amount. The effect, when a plurality of the blocks are assembled, is the mounting strips give the finished wall the appearance of a clay brick wall with mortar joints. Each block includes vertically aligned closed channels suitable for containing steel rebar and grout for strength.

In U.S. Pat. No. 5,729,943 Cambiuzzi discloses a block comprising a transverse groove in each end face, and an opening extending from the first to the second bearing face in which a longitudinal groove is also provided. The block is further provided with reference and positioning structures comprising a pair of longitudinal seats on the bearing face, and a pair of projections each divided into three projection portions on the second bearing face. The apertures and the grooves in the blocks form a grid of intersecting vertical and horizontal channels in which binder or grout is poured and solidifies. These channels may incorporate steel rebar for enhanced strength.

In U.S. Pat. No. 5,802,797 Storer-Folt discloses a masonry system in which specially shaped bricks are dry-stacked and subsequently bonded by pouring mortar or grout into apertures in the brick to flow through the stacked structure to surround the individual brick leaving the front and rear faces exposed. The brick have alignment projections extending from the bottom bed faces which register with alignment grooves in the top bed faces of the lower brick to align the upper brick prior to bonding. The projections and grooves define a recess to admit mortar between adjacent brick faces. The brick also have recesses in the header faces to admit mortar between adjacent header faces. The front faces of the brick are contoured to create the appearance of mortar joints when the brick are stacked. As with other designs, the brick includes rectangular or oval vertical channels to admit inclusion of steel rebar and grout for strength.

In U.S. Pat. No. 6,588,168 Walters discloses a block shaped in the general form of a rectangle. There is a single channel portion of uniform depth extending along the entire length dimension of the block, which channel has an open portion coincident with the top portion. To accommodate vertically placed steel rebar, the channel includes at least one, and preferably two holes on its floor portion, which have a centerline coincident with the height dimension of the block and which pass through to the exterior of the block through the flat bottom portion.

In U.S. Pat. No. 6,962,028 Banova discloses a masonry block comprising contoured headers, a contoured front face, a back face, a contoured lower base and an upper base. The masonry block has a plurality of holes extending from the lower base to the upper base to accommodate vertical steel rebar and grout for enhanced strength. The contoured headers couple to the headers of other masonry blocks and the contoured lower base couples to the upper base of the other masonry blocks so that an outward face of a portion of a wall assembled with the masonry blocks has mortar-like vertical and horizontal gaps.

There persists in the prior art a continuing need for improvements in construction block systems to permit more rapid assembly of the blocks. There is a need to avoid the incorporation of mortar joints between the bricks with its attendant cost in time, labor, and material, but to retain the aesthetically pleasing appearance of mortared joints. On the other hand the need for constructs of enhanced structural strength and integrity persists.

The prior art provides for vertical and horizontal channels so that strength properties derived from the incorporation of steel rebar and grout are obtained. However, in every case where the vertically positioned rebar has already been set in a concrete foundation, it is necessary to lift each masonry block so that it passes over the top end of the rebar. This additional effort is obtained entirely through manual labor incurred with the placement of each masonry block, and the cumulative effect is a significant cost in time and labor.

Therefore, there is a continuing need for improvements in construction block systems to permit lower cost and more rapid structure assembly from the blocks, while still permitting the introduction of reinforcing material into all or some of the blocks. The present invention provides a block useful in the rapid construction of various structures, with structural strength properties derived from the incorporation of steel rebar and grout reinforcing, and the aesthetically pleasing appearance of mortared joints. The features and advantages of the blocks and constructs of this invention will become apparent to one of ordinary skill.

SUMMARY OF THE INVENTION

The present invention provides a block useful in the construction of walls and structures that is shaped in the general form of a rectangular solid. A block according to the invention comprises: a top portion, an approximately flat bottom portion, a front face portion, a rear face portion, and two end portions. In this application the term "masonry block" or simply "block" refers to any suitable masonry unit including bricks, clay, or concrete blocks that are shaped in the preferred configurations of this disclosure.

The block includes a single horizontal channel extending along its entire length dimension, which channel is open coincident with the top portion of the block. The channel has a floor where the lowermost point is preferably disposed between about 20% to 50% of the height dimension of the block. The channel has a preferred width of between about 30% to 70% of the width dimension of the block.

There are further open channels vertically aligned and associated with each end portion, facing outwards, and when assembled into a wall, abutting an adjacent masonry block end. The open vertical channels each have an interior side where the deepest point of each is disposed to the center of the block between about 30% to 40% of the length dimension of the block. The channel has a preferred width of between about 30% to 70% of the width dimension of the block.

A protruding portion is incorporated into the flat bottom portion, which extends along the entire length dimension of the block, and its width is defined by the horizontal channel in the top portion. The width of the protrusion on the bottom portion matches the width of the open channel on the top portion so that an interlocking connection is formed when another masonry block is positioned upon it in the assembly of a wall or other structure.

Finally, there is further a protruding rectangular portion incorporated into the front face portion, and optionally into the rear face portion. The protrusions on the face portions have length and width dimensions of between about 80% to 95% of the respective length and width dimensions of the face upon which they are incorporated. These protrusions are aligned coincident with one corner of the face portion, leaving a recess along one end, and along either the top or bottom edge of the face portion, so that when assembled into a wall, the recessed parts of the face portions give the appearance of mortar joints.

To provide a wall construction using the blocks of the invention, a single first row of blocks as described is first laid in an end to end arrangement into a freshly poured concrete foundation or footer. Where rebar protrudes vertically from the concrete foundation or footer, the block of the present invention may be positioned so that the open vertical channels at each end portion contain and are aligned with the vertical rebar.

Subsequent rows of blocks according to the invention are stacked atop the first row of blocks in a staggered configuration with respect to the adjacent lower row of blocks, thus defining a horizontal channel extending along the length of the second row of blocks. Horizontal rebar may be provided within any horizontal channel so formed as needed for a bond beam to meet structural engineering requirements.

The vertically-oriented rebar within the vertical channels along the length of the wall does not require excessive lifting of the masonry blocks of the present invention by workers, because the open channels of each end portion admit the positioning of the masonry block around fixed vertical rebar. A castable cement, concrete, or grout is then poured into the vertical channels and in the process also flows into and through the horizontal channels. The result is a wall having a beneficial combination of superior strength, simplified fabrication, and reduced labor costs over structures found in the prior art.

OBJECTS OF THE INVENTION

Accordingly, it is an object of this disclosure to provide improved interlocking masonry blocks that so that an outward face of a structure made with the masonry blocks have a mortar-like gap located between each of the masonry blocks.

It is a further object of this disclosure to provide the means for assembling structures using interlocking masonry blocks that reduce labor costs and the chance for worker strain or injury, increase worker efficiency, and reduce time to complete the project.

It is a further object of this disclosure to provide the means for assembling structures for architectural constructions such as octagonal columns.

Other objects, features and advantages of the present invention will become apparent from the following description when taken in conjunction with the accompanying drawings wherein like characters of reference designate corresponding parts throughout the several views.

DETAILED DESCRIPTION OF EXEMPLARY EMBODIMENTS

In this application the term "masonry block" or simply "block" refers to any suitable masonry unit including bricks, clay, or concrete blocks that are shaped in the preferred configurations of this disclosure.

Figure 1:
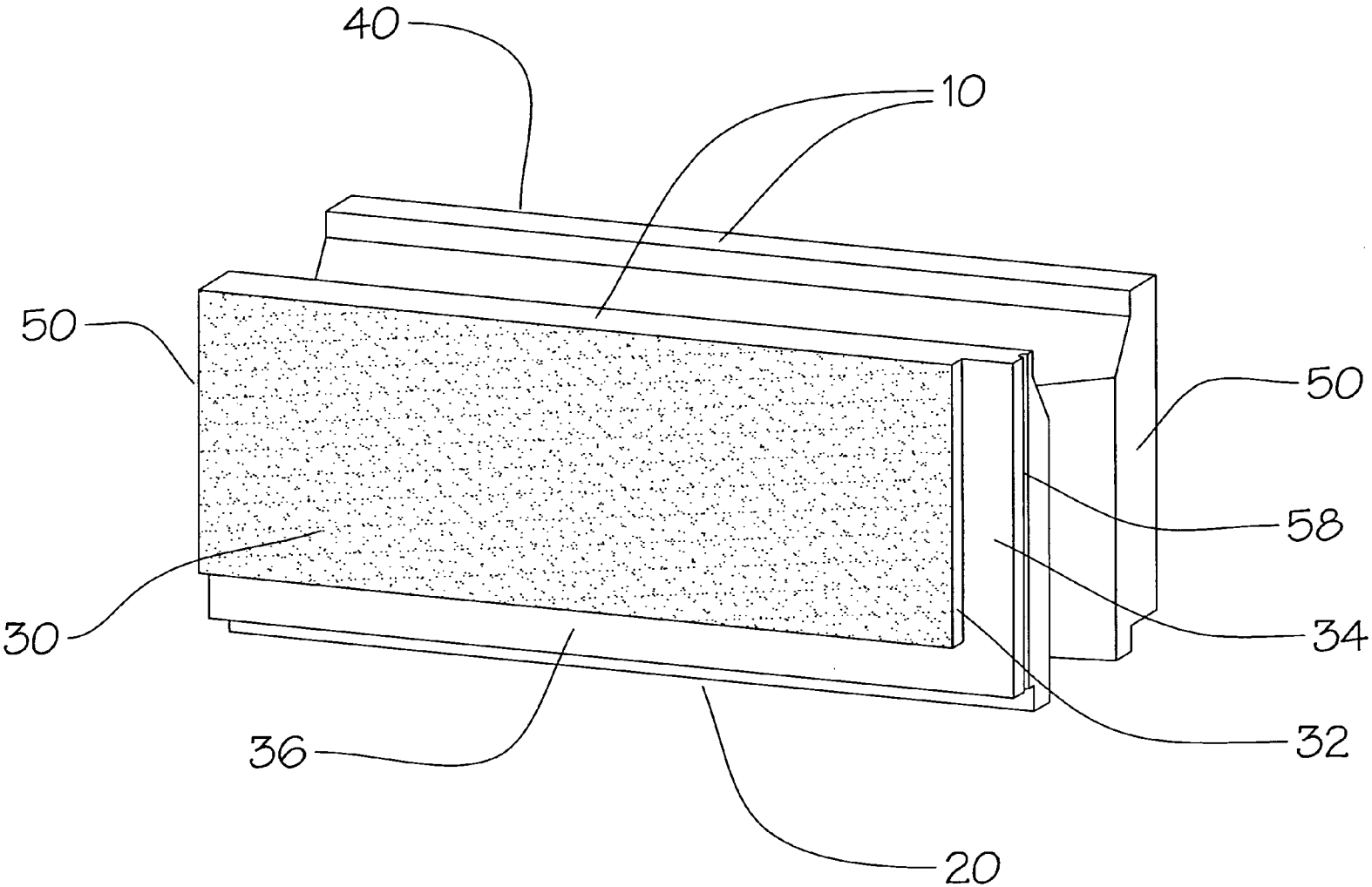
FIG. 1 Shows a front perspective view of the basic masonry block.

The present invention provides a block useful in the construction of walls and structures that is shaped in the general form of a rectangular solid. FIG. 1 illustrates the basic block 1 according to the invention which comprises a contoured top portion 10, a flat bottom portion 20, a front face portion 30, a rear face portion 40, and two end portions 50.

Figure 2:
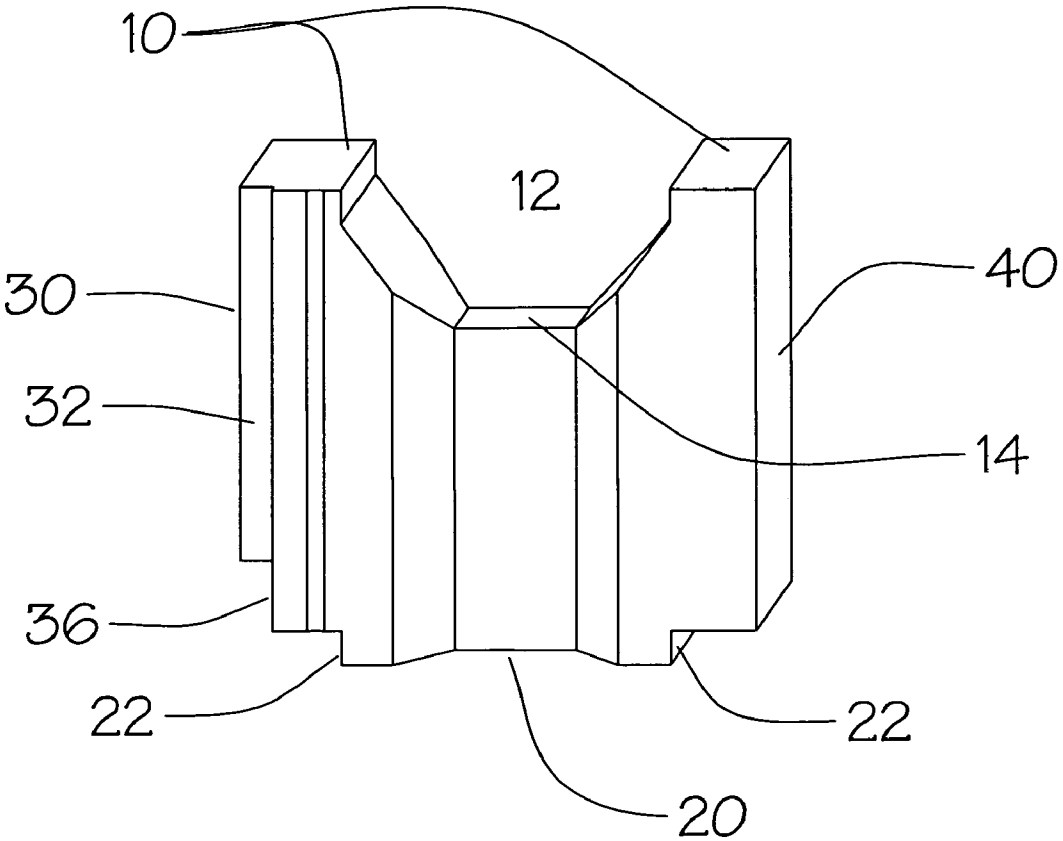
FIG. 2 Shows an end perspective view of the basic masonry block slightly from the inside.
Figure 3:
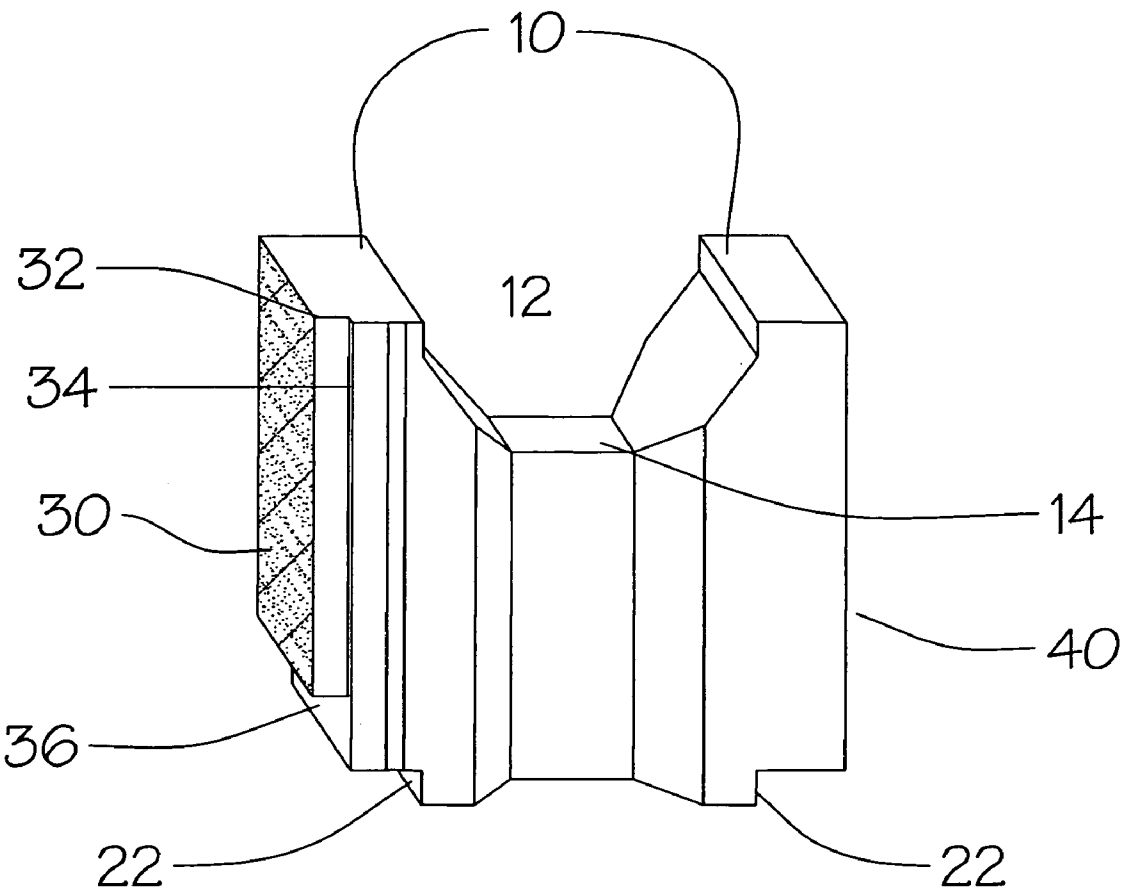
FIG. 3 Shows an end perspective view of the basic masonry block slightly from the outside.

There is a single horizontal channel 12 extending along the entire length dimension of the block, as illustrated in FIG. 2 and FIG. 3, where the channel is open coincident with the top portion 10 of the block. The channel has a floor 14 where the uppermost point is preferably disposed between about 20% to 50% of the height dimension of the block. The channel 12 at its widest point has a preferred width of between about 30% to 70% of the width dimension of the block. The cross-section shape of the channel may be rectangular, semi-circular, parabolic, oval, triangular, u-shaped, or other similar configuration.

Figure 4:
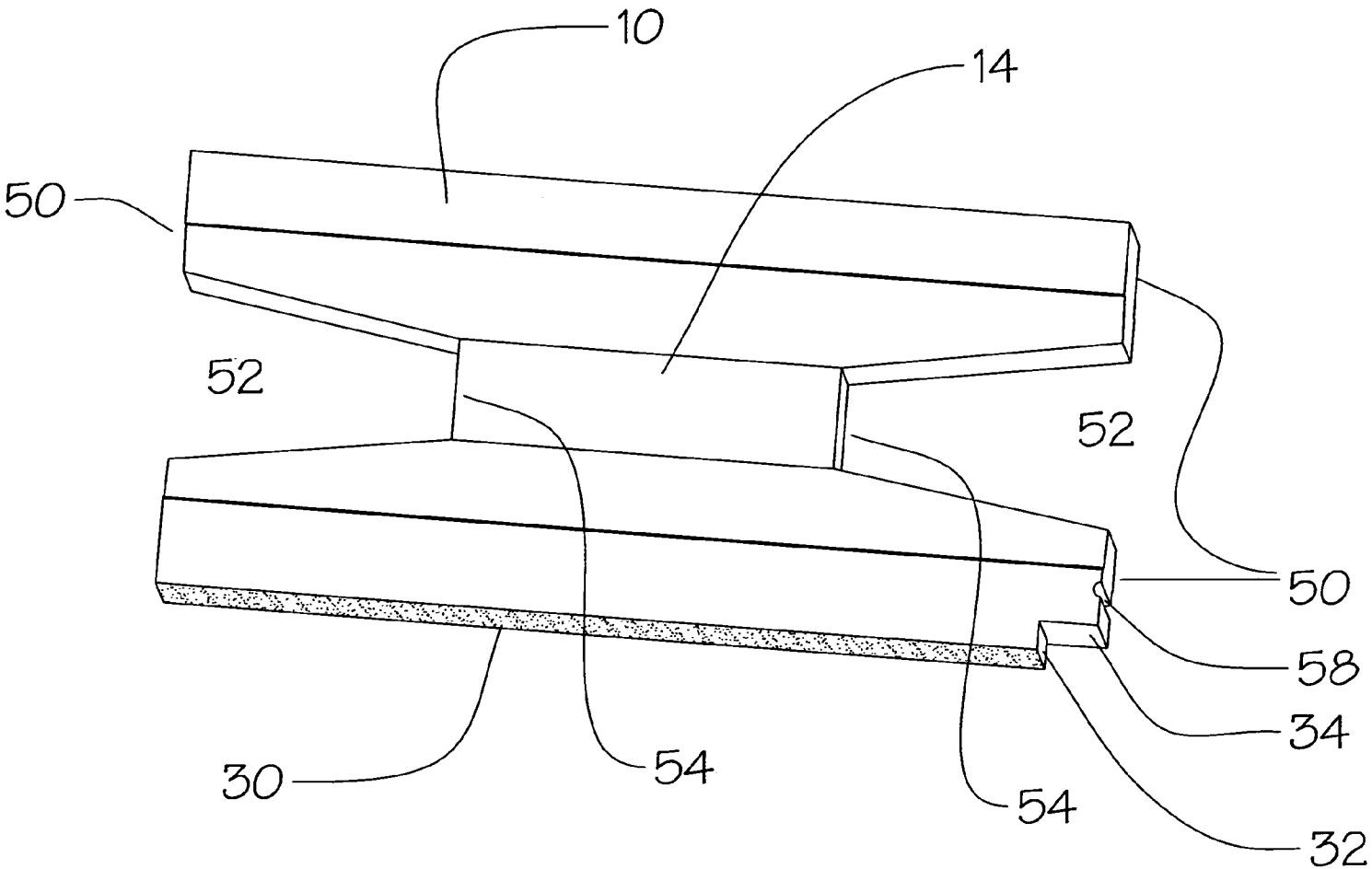
FIG. 4 Shows a top perspective view of the basic masonry block.

There is further an open channel 52 vertically aligned and associated with each end portion 50, facing outwards toward an adjacent masonry block end. These channels 52 are illustrated in FIG. 4. The open vertical channels 52 each have an interior side 54 where the deepest point of each is disposed to the center of the block between about 30% to 40% of the length dimension of the block. The open vertical channels 52 have a preferred width of between about 30% to 70% of the width dimension of the block. The cross-section shape of the channel may be rectangular, semi-circular, parabolic, oval, triangular, u-shaped, or other similar configuration.

As illustrated in FIG. 2, there is further a protruding portion 22 incorporated into the flat bottom portion 20, which extends along the entire length dimension of the block, and is defined by the flat bottom portion 20. The width of the protrusion on the bottom portion 22 is defined to match the maximum width of the open channel 12 on the top portion 20 so that an interlocking connection is formed when another masonry block is positioned upon it in the assembly of a wall or other structure.

There is further a an optional protruding rectangular portion 32 incorporated into the front face portion 30, and optionally into the rear face portion 40. This face protrusion 32 is illustrated in FIG. 1, FIG. 2, FIG. 3, and FIG. 4. The protrusions 32on the face portions have length and width dimensions of between about 80% to 95% of the respective length and width dimensions of the face portion 30 or 40 upon which they are incorporated. These protrusions are aligned coincident with one corner of the face portion, leaving a recess 34 along one end, and along either the top 36 or bottom edge of the face portion, so that when assembled into a wall, the non-protruding or recessed parts 34 and 36 of the face portion give the appearance of mortar joints. Thus for example, one embodiment of the invention may have the protruding face set to the upper left edge of the overall masonry block, as shown in FIG. 1.

The protrusions are optional where desired for aesthetic reasons, or where, for example the interior surface of a wall so formed as part of a building will be finished with plaster, insulation, drywall or other material. The protrusion 32 on the face portion may have incorporated an alternate finished texture, such as rougher or smoother when compared to the recessed parts 34 and 36 to help simulate the appearance of brick and mortar joinery. Optionally a pattern or design embedded in the face protrusion 32 may be included to enhance aesthetic qualities.

FIG. 1 also illustrates a small channel 58 embedded along the entire height of the exterior portion of one end face 50. The channel 58 is about ⅛" in depth, and may be used to provide a seat for a bead of caulking or sealer or the like, in order to improve the water sealing properties of the masonry block.

Figure 5:
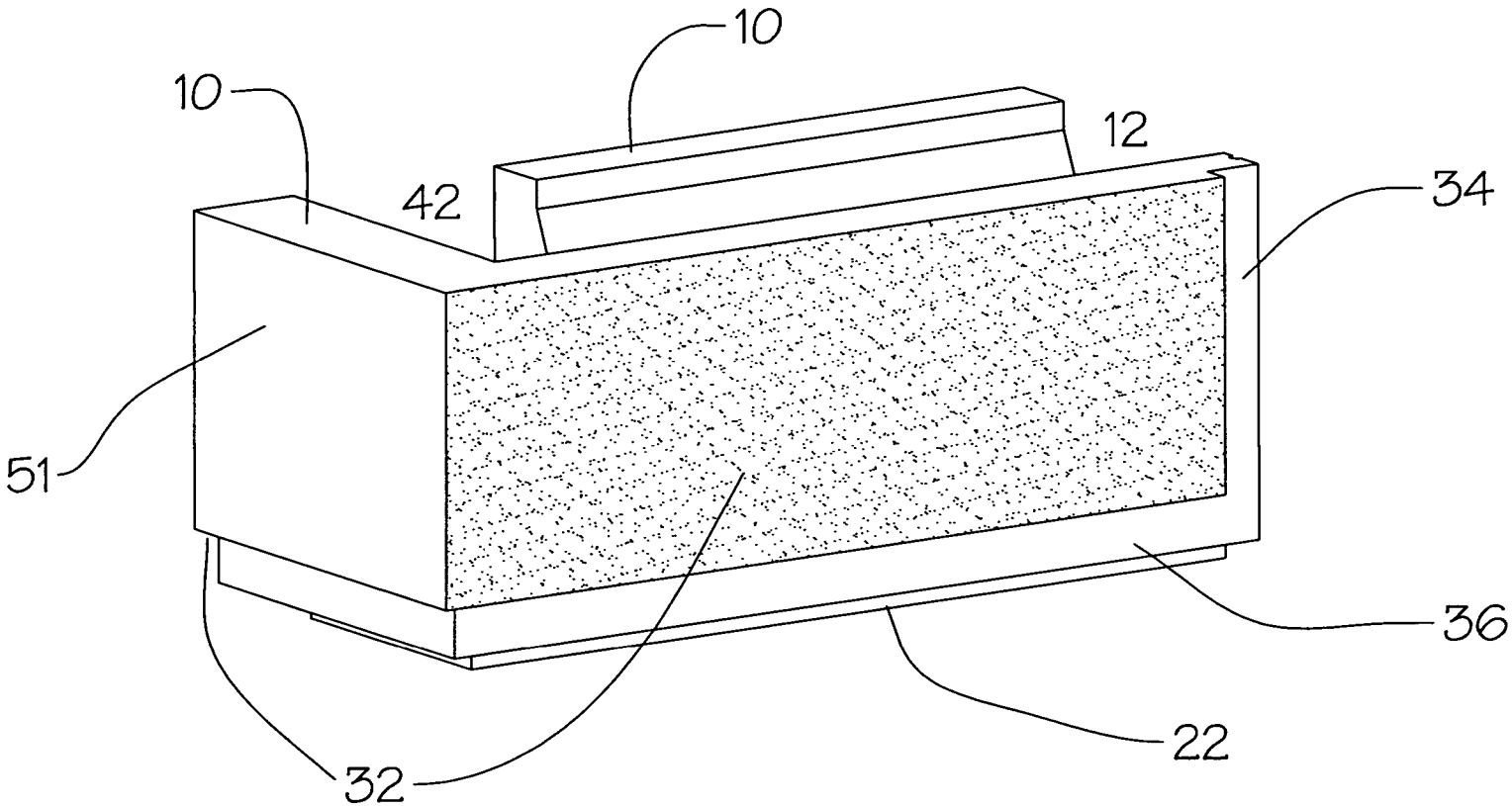
FIG. 5 Shows a front perspective view of the right-handed corner masonry block.
Figure 6:
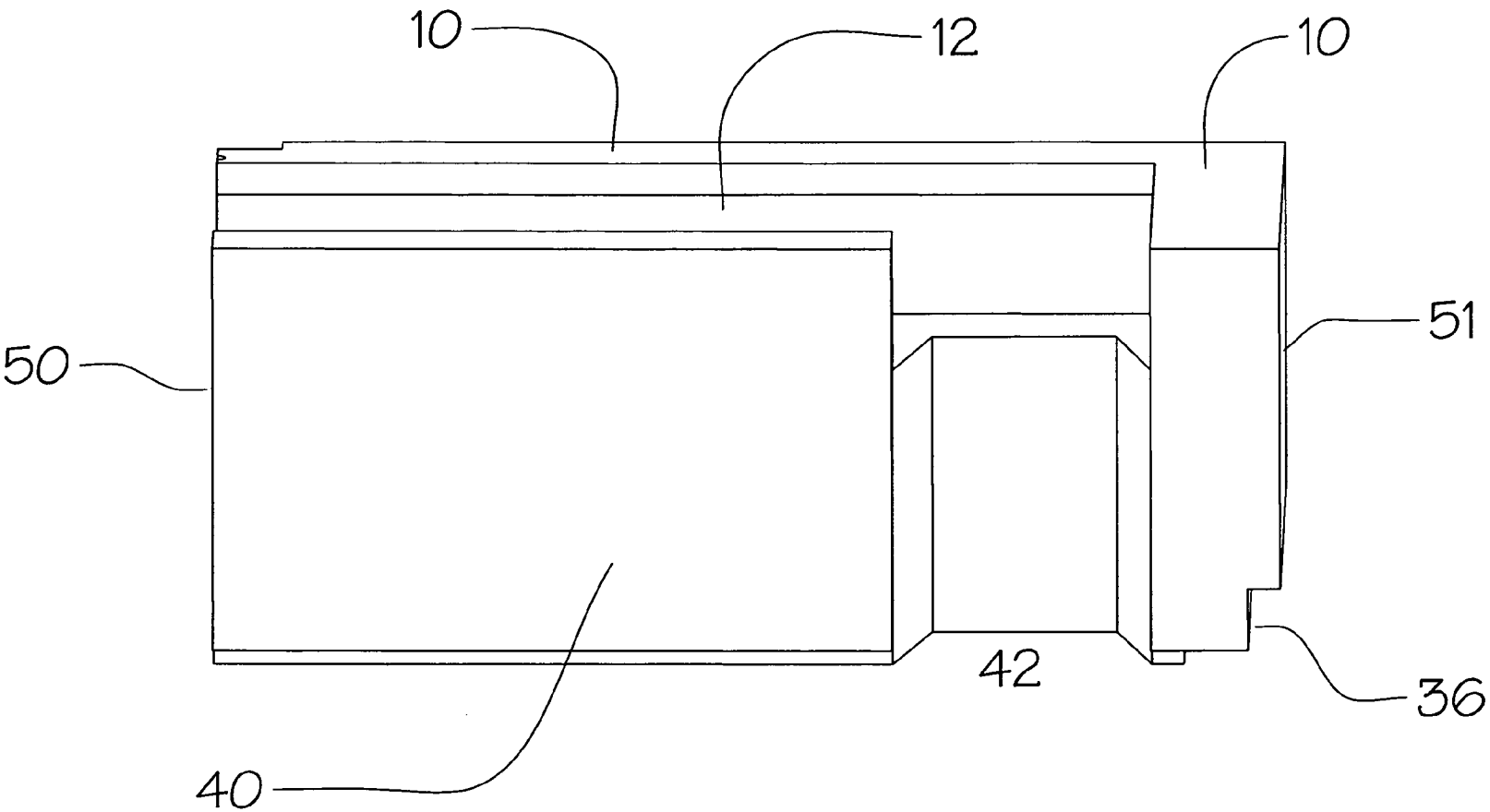
FIG. 6 Shows an inside perspective view of the right-handed corner masonry block.
Figure 7:
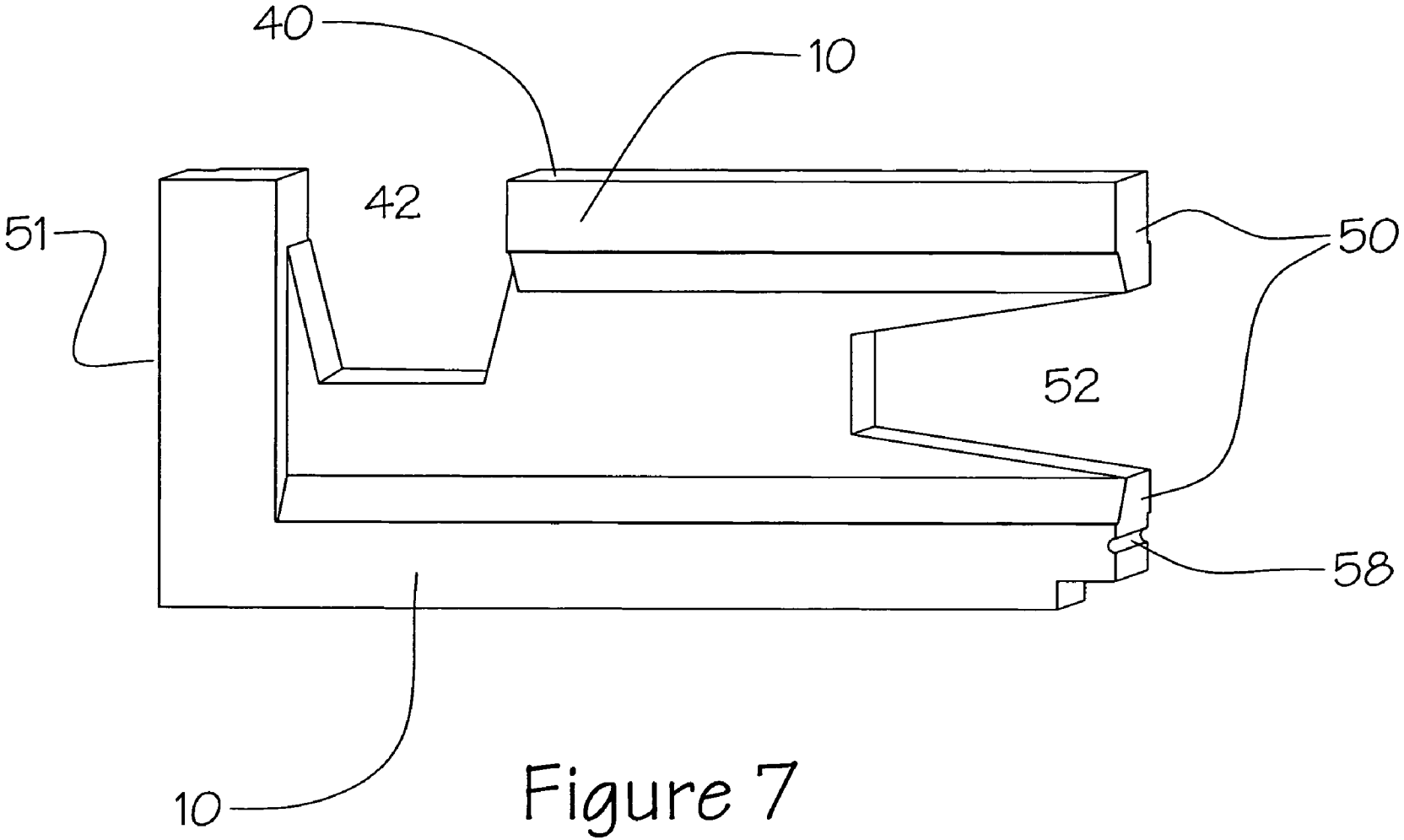
FIG. 7 Shows a top perspective view of the right-handed corner masonry block.

FIG. 5 shows a right-handed corner masonry block to be used with the system of the present invention. This unit includes a horizontal channel 12 in the top portion 10 as with the basic masonry block, but the channel stops before it reaches the proximal closed end portion 51 of the masonry block. The closed end portion 51 may have a flat face. Alternately the closed end portion 51 may have a protrusion 32 from the face for the aesthetic purposes of simulating mortared joints in the finished structure. Additionally, the inside portion of the masonry unit has a vertical channel 42 located at one end, to coincide with the vertical channels 52 described for the basic masonry block that may be placed at right angles to it in an assembled wall. FIGS. 6 and 7 also illustrate of the geometry of the right-handed corner unit.

Figure 8:
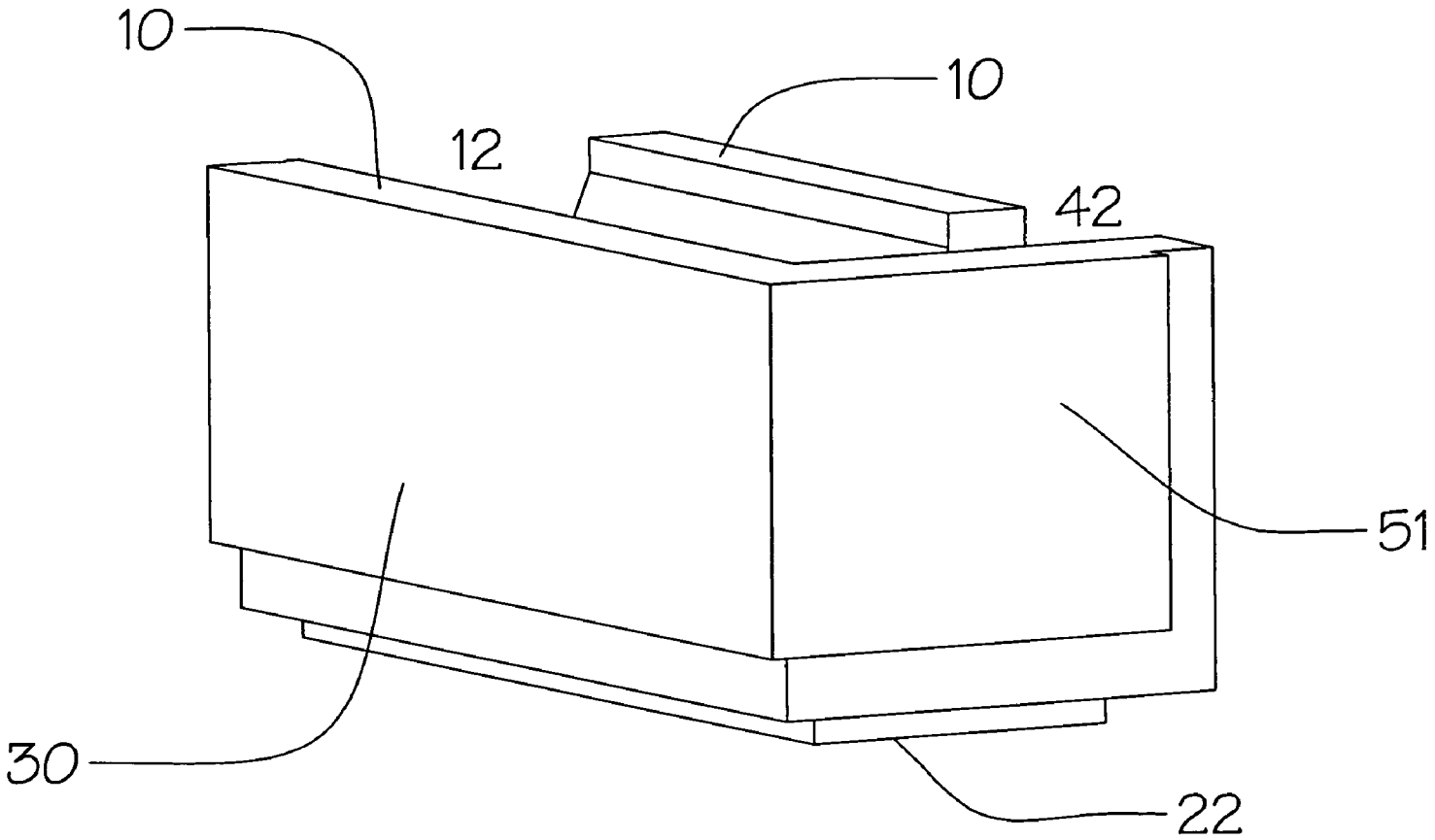
FIG. 8 Shows a perspective view of the left-handed corner masonry block.
Figure 9:
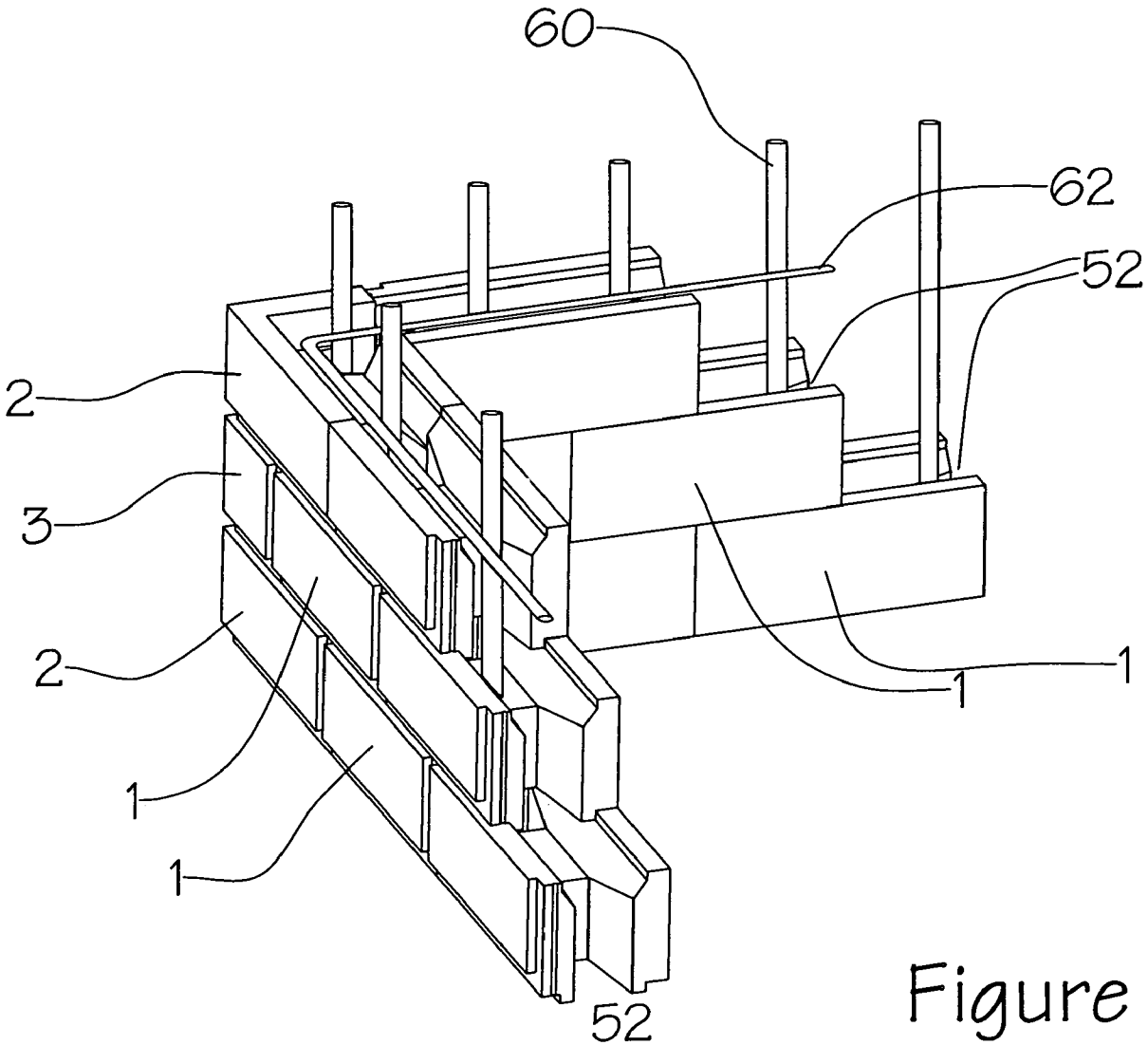
FIG. 9 Shows a perspective view of an assembled wall at a corner.

Two related configurations of such corner blocks are provided to reflect the necessary asymmetry of the blocks when used in alternating rows. One configuration is a right-handed masonry block 2 as shown in FIG. 5, and the other is a left-handed masonry block 3 in FIG. 8. With the use of the corner blocks as described herein, bent rebar may be laid in the system of horizontal channels formed by adjacent blocks through and around corners in the wall, as shown in FIG. 9.

To provide a wall construction using the blocks of the present invention, a single first row or layer of blocks 1 as described is laid in an end to end arrangement into a freshly poured concrete foundation or footer. FIG. 9 illustrates three such rows. Alternately, the first row of blocks may be applied to a hardened foundation or footer with mortar. The open vertical channels 52 of adjacent blocks combine to form vertical cavities. Where rebar 60 protrudes vertically from the concrete foundation or footer, the block of the present invention may be positioned so that the open vertical channels 52 at each end portion contain and are aligned with the vertical rebar 60.

Subsequent rows of blocks according to the invention are stacked atop the lower rows of blocks in a staggered configuration with respect to the adjacent lower row of blocks, as illustrated in FIG. 4. Because the horizontal channels 12 of each masonry block run the entire length of the block, the channels 12 coincide to define a horizontal channel extending along the entire length of the second row of blocks, as well as the length of every other subsequent row. Horizontal rebar 62 may be provided within any horizontal channel so formed as needed for a bond beam to meet strength and engineering requirements. Spacers or supports for the horizontal rebar may be incorporated to elevate the rebar from the bottom of the channel space if desired. The foregoing is repeated until a desired height of blocks is achieved.

Excessive lifting of the masonry blocks of the present invention is not required to position them around vertically-oriented rebar 60, because the open nature of the channels 52 of each end portion 50 admit the positioning of the masonry block around the rebar 60. A castable cement, concrete, or grout is then poured down into the vertical channels and flows into the horizontal channels 22. The cement fills the vertical holes and horizontal channels under the force of gravity, and with time cures, thus providing a wall having a beneficial combination of superior strength, simplified fabrication, and economic cost over prior art structures.

The blocks may be of any suitable dimensions. Preferred dimensions include about 8 inches overall length and between about 3 to 4 inches width and about 3 to 4 inches height, so that the blocks may be handled readily, and conform to construction industry preferred dimensions, such a 8" on-center spacing. The blocks may be formed by methods well known in the prior art, such as through extrusion processes, or use of casting forms. The preferred method of manufacture is to cast concrete or other suitable aggregate into forms built to the corresponding shape and dimensions of the blocks desired.

Figure 10:
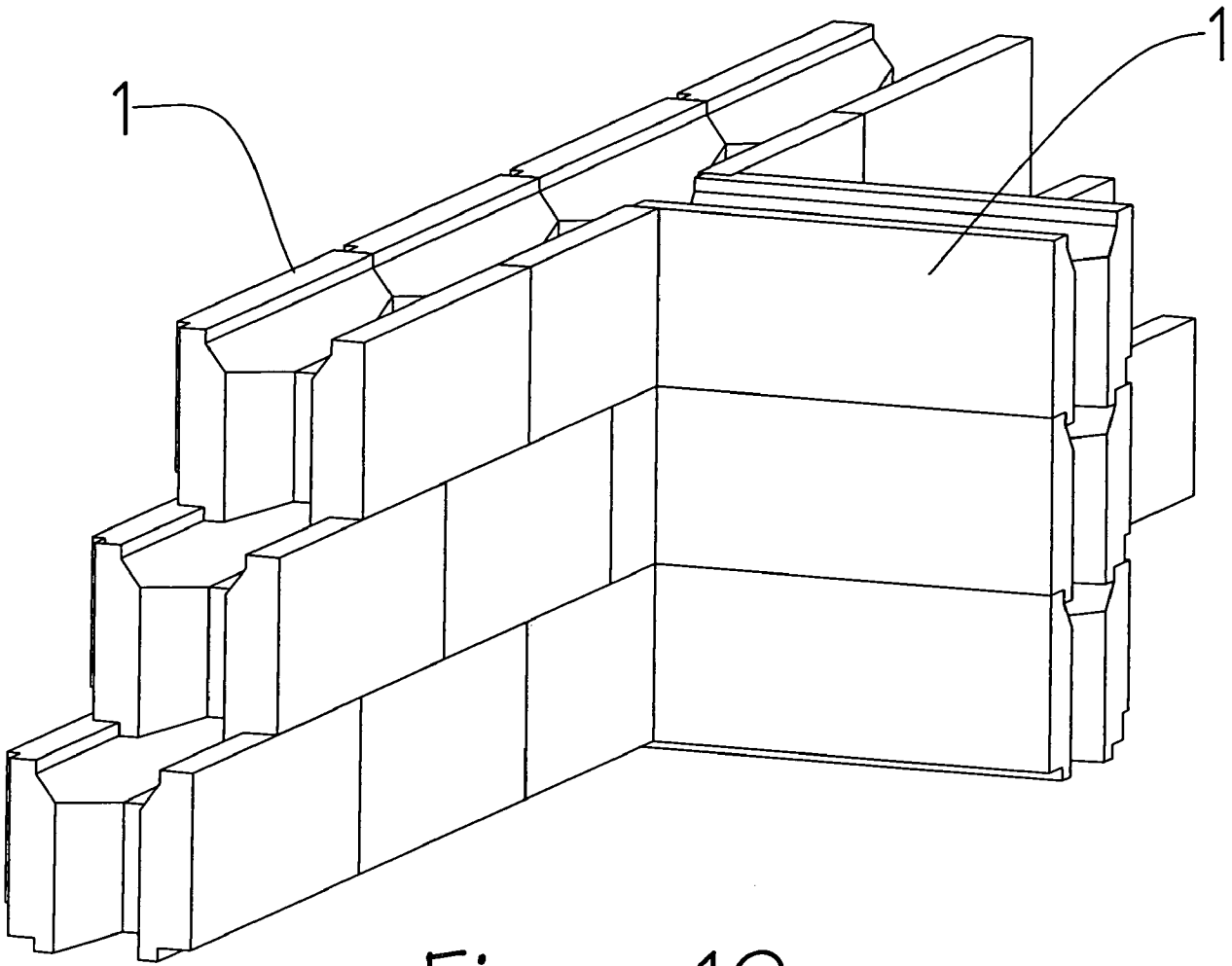
FIG. 10 Shows a perspective view of an assembled wall intersection.

The basic masonry blocks may be adapted for use in special situations. Thus, for example, the blocks way be trimmed on-site by means of a masonry saw so that a junction of walls may be obtained. One result is illustrated in FIG. 10, which shows three rows of the basic masonry block 1 intersected by three rows of the basic masonry block 1 at right angles. In this figure, the longer wall section portrays the blocks in the customary staggered layers, while the intersecting row is stacked vertically in columns. Alternatively, if desired, the intersecting row may also be staggered by use of half blocks, using basic masonry blocks 1 that have been cut in half, or alternatively, blocks cast or formed to the reduced dimensions.

Figure 11:
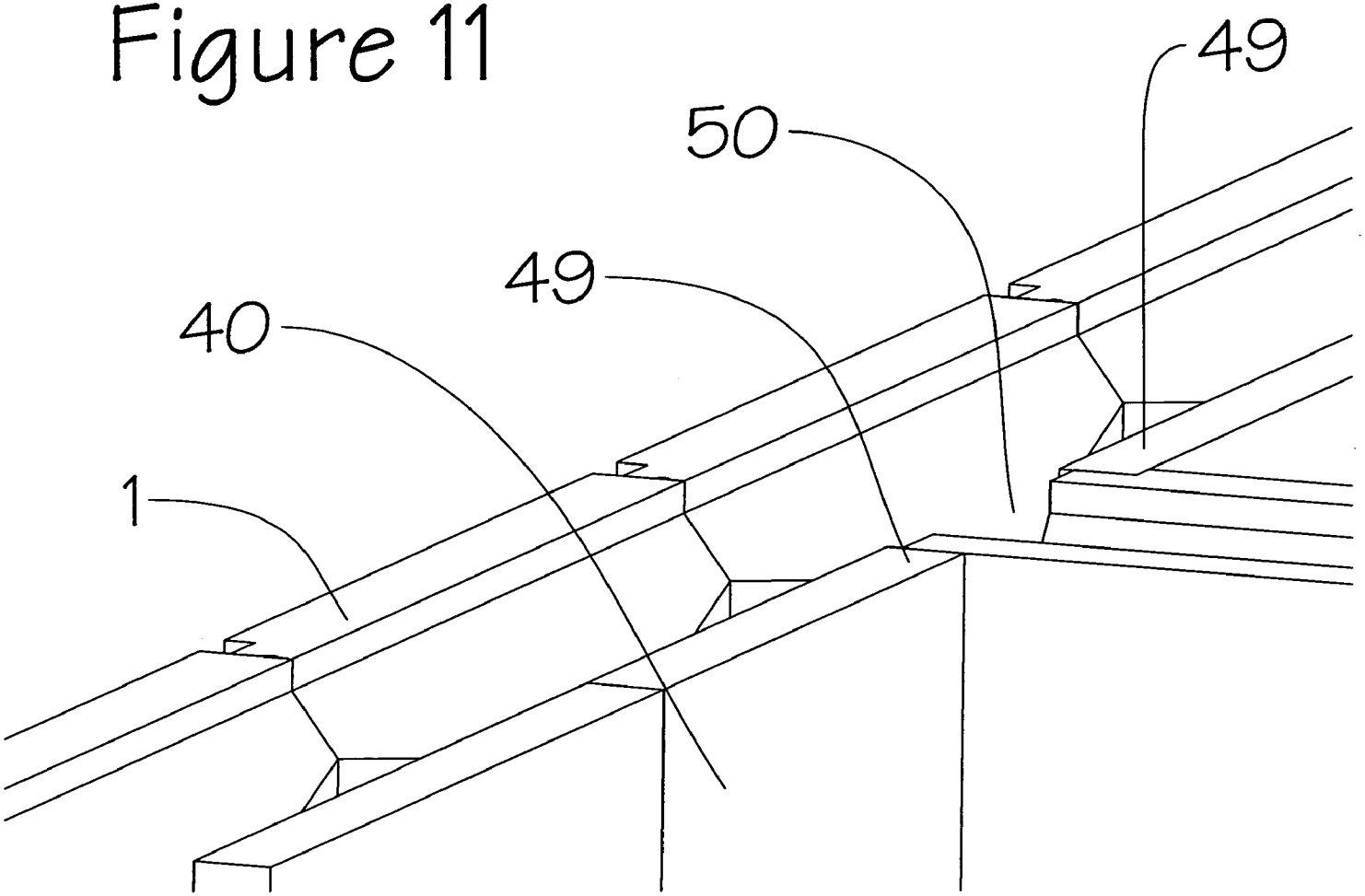
FIG. 11 Shows a detailed perspective view of a wall intersection.

Trimming the blocks 1 allows the channels to open up so that bent rebar may be placed horizontally in the wall, and grout may be poured to impart strength to the wall junction. In FIG. 11, details of the trimmed rear face portions 40 of the basic masonry block are illustrated as an example. Thus the rear face portions 40 of two masonry blocks 1 have been cut at edges 49 so that the open end 50 of an intersecting block may insert between them and form both horizontal and vertical channels for admission of rebar and grout.

Figure 12:
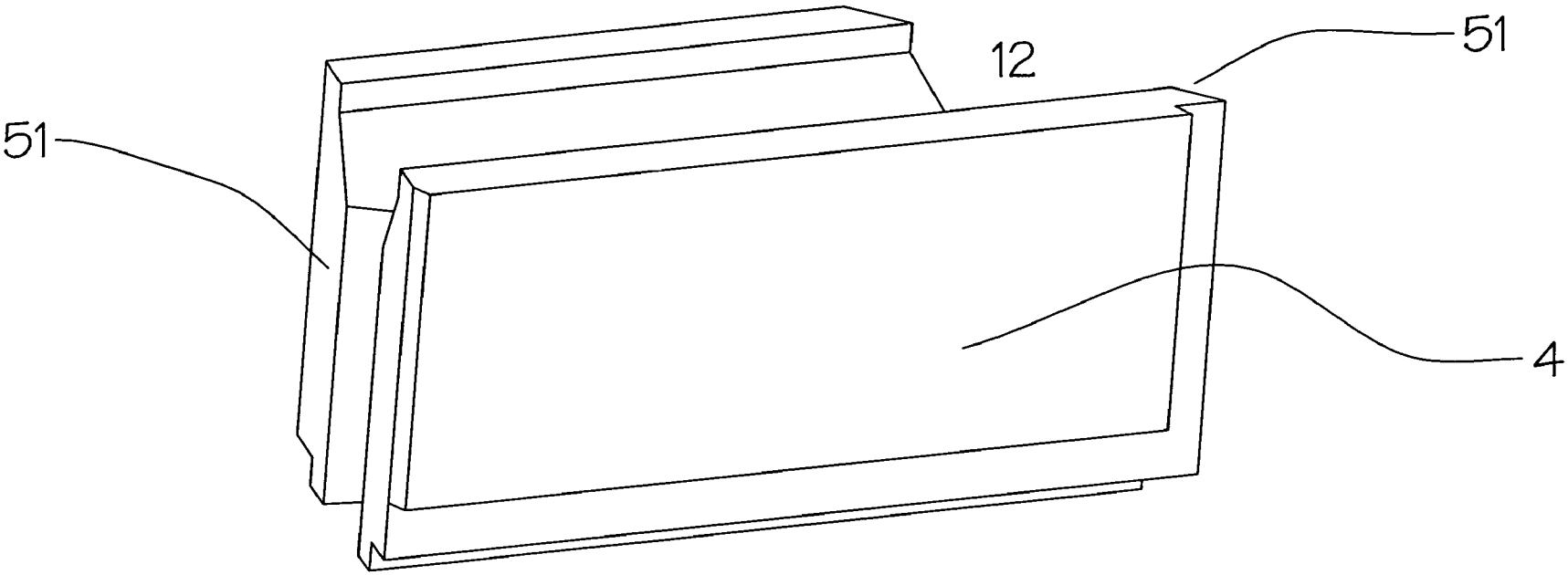
FIG. 12 Shows a perspective view of a basic masonry block for use in an octagonal column.
Figure 13:
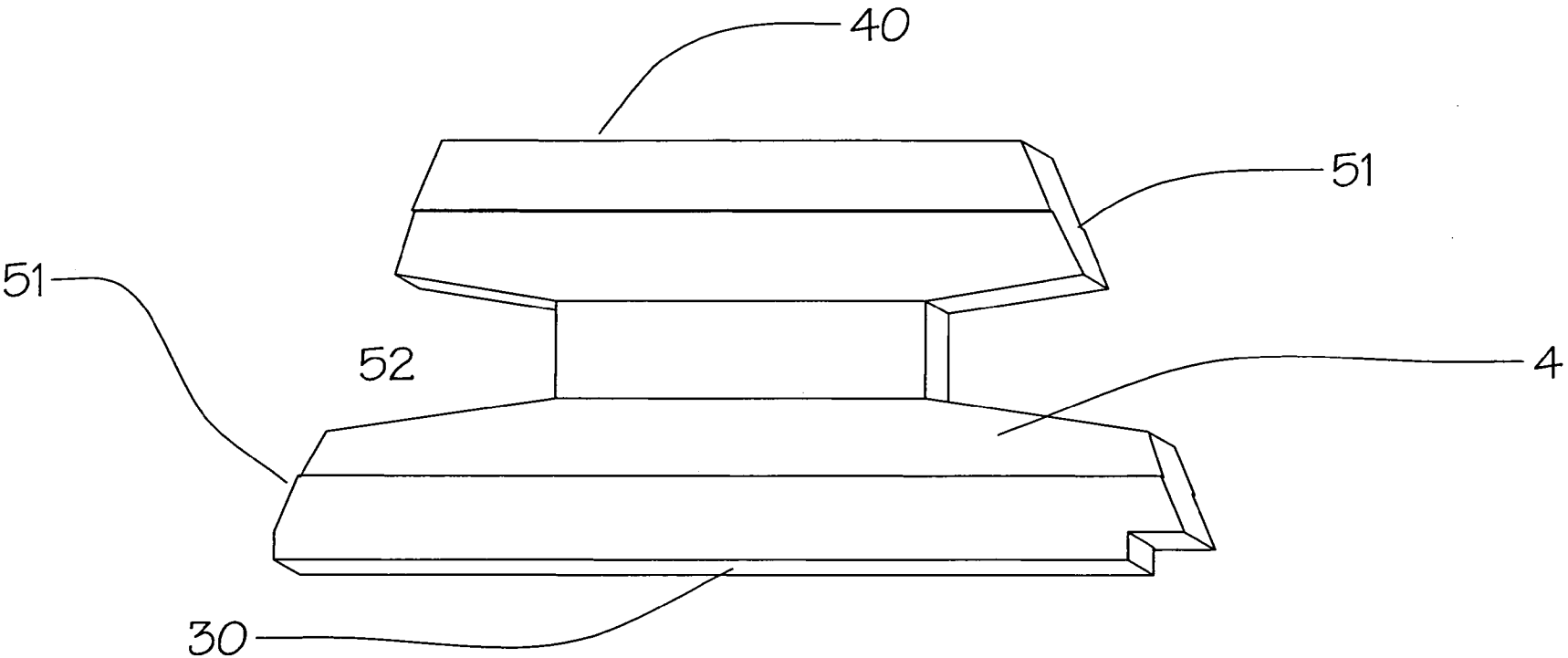
FIG. 13 Shows a top perspective view of a basic masonry block for use in an octagonal column.

The basic masonry blocks may be adapted for use in special constructions. Thus, for example, the basic masonry block may be cut at an angle at each end 51 so that a tapered masonry block 4 is formed as shown in FIGS. 12 and 13. Alternatively, the angled end portions 51 may be provided for in a casting mold when the masonry block units are formed. The end portions of the basic block are cut or cast at an angle suitable for the desired geometry of the construct to be formed, for example as a large octagonally shaped column.

Figure 14:
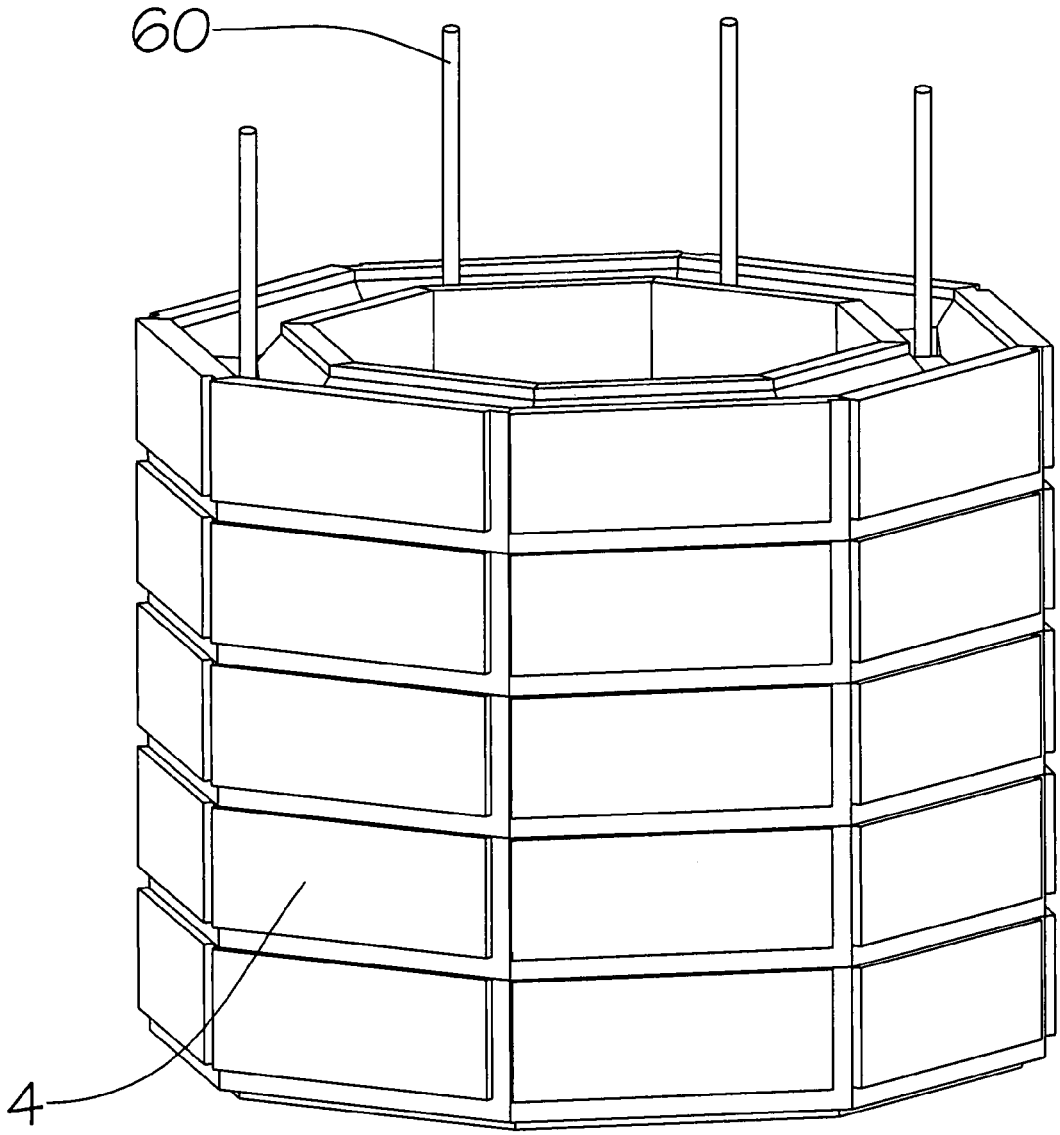
FIG. 14 Shows four rows of an octagonal column formed from angle-cut basic units.

For such an octagonal column, the desired angle of each cut is at or about 22.5 degrees. Such an octagonal column formed with 5 rows of tapered masonry blocks 4 arranged in an octagon, with vertical rebar 60, is shown in perspective in FIG. 14. In an alternative construct comprising a hexagonal column, for example, the preferred angle to cut each basic block is at or about 30 degrees. Other geometries of columns and other structural or architectural assemblies may also be constructed by modifications obvious to those skilled in the art.

Although the foregoing embodiments of the present invention have been described in some detail by way of illustration and example for purposes of clarity and understanding, it will be apparent to those skilled in the art that certain changes and modifications may be practiced within the spirit and scope of the present invention. Therefore, the description and examples presented herein should not be construed to limit the scope of the present invention, the essential features of which are set forth in the appended claims.

I claim:

1. A rectangular solid masonry block comprising;

a) a solid rectangular block having a top portion, a bottom portion, a front face portion, a rear face portion, a first end portion and a second end portion, b) a single horizontal "U" shaped channel extending the length of the block and open along a central area of said top portion, said single horizontal "U" shaped channel exposing a solid floor section, c) a single vertical "U" shaped channel extending the height of the block and open along a central area of each said first end portion and said second end portion, the single vertical "U" shaped channel forming a pair of vertical members on said first end portion and said second end portion, d) a rectangular protrusion extending down from and running the length of said flat bottom portion with a width corresponding to the width of said horizontal "U" shaped channel, e) a vertical channel running a length of one of the pair of vertical members on said first end portion, wherein said one of the pair of vertical members on said first end portion is located adjacent to the front face portion of the block and provides a housing for a sealant, f) a vertical oriented edge running a length of one of the pair of vertical member of said second end portion, wherein said vertical oriented edge is formed on said one of the pair of vertical members on said first end portion located adjacent to the front face portion of the block and runs parallel with the vertical channel, wherein a plurality of said solid masonry blocks may be readily assembled without mortar to form a structure or wall, and said single horizontal channel from a plurality of said solid masonry blocks align, and said single vertical channel from a plurality of said solid masonry blocks align to admit horizontal and vertical rebar and poured grout.

2. The rectangular solid masonry block of claim 1 where the said front face portion contains a protrusion extending out from the surface leaving recessed areas along two adjacent edges of said front face portions, so that an outward face of a portion of a wall assembled with said plurality of masonry blocks has mortar-like vertical and horizontal gaps.

3. The rectangular solid masonry block of claim 2 where the said rear face portion contains a protrusion extending out from the surface leaving recessed areas along two adjacent edges of said front face portions, so that both outward and inward faces of a wall assembled with said plurality of masonry blocks has mortar-like vertical and horizontal gaps.

* * * * *